US007959020B2

(12) United States Patent
Rosen

(10) Patent No.: US 7,959,020 B2
(45) Date of Patent: Jun. 14, 2011

(54) WIRE RACK FOR MOUNTING AN IRON ON A WALL

(75) Inventor: Frederick K. Rosen, Wheaton, IL (US)

(73) Assignee: Panacea Products Corp., Cleveland, OH (US)

( * ) Notice: Subject to any disclaimer, the term of this patent is extended or adjusted under 35 U.S.C. 154(b) by 728 days.

(21) Appl. No.: 11/612,716

(22) Filed: Dec. 19, 2006

(65) Prior Publication Data

US 2008/0164384 A1 Jul. 10, 2008

(51) Int. Cl.
*A47G 29/087* (2006.01)

(52) U.S. Cl. ..... 211/119.001; 211/106; 211/119; 211/181.1; 211/85.31; 211/90.03; 248/685; 248/302; 248/303

(58) Field of Classification Search ..... 248/117.1, 248/117.2, 117.7, 302, 303, 685, 112, 175, 248/176.1, 274.1, 317, 323, 339; 211/106, 211/88, 90, 119, 85.24, 85.29, 85.31, 86.01, 211/87.01, 90.02, 90.03, 102, 105.3, 113, 211/117, 181.1, 119.001; 38/103, 104, 106
See application file for complete search history.

(56) References Cited

U.S. PATENT DOCUMENTS 2,530,027 A * 11/1950 Perrigo ..... 248/117.1
4,893,770 A * 1/1990 Bejak et al. ..... 248/117.1
4,895,334 A * 1/1990 Bajek et al. ..... 248/302
5,588,543 A * 12/1996 Finger ..... 211/90.01
5,743,417 A * 4/1998 Mathis ..... 211/119
D399,415 S * 10/1998 Gay ..... D8/370
5,921,410 A * 7/1999 Emery et al. ..... 211/88.01
7,004,433 B2 * 2/2006 Clausen et al. ..... 248/117.1
D566,445 S * 4/2008 Rosen ..... D6/566
2006/0102809 A1 * 5/2006 Broeders ..... 248/95

OTHER PUBLICATIONS

Ironing Board Porta-Hanger #442.
Deluxe Iron & Ironing Board Holder.
Ironing Kaddy Center #438.
Iron & Ironing Board Kaddy #440.

* cited by examiner

*Primary Examiner* — Terrell McKinnon
*Assistant Examiner* — Todd M. Epps
(74) *Attorney, Agent, or Firm* — Vedder Price P.C.

(57) ABSTRACT

The present disclosure relates to a wire rack for mounting an iron on a wall and method of use thereof, and more specifically, to a wire rack for mounting an iron on a wall, the wire rack having a retractable rail for adjusting to different sizes of irons and equipped with an ironing board holder and a product holder. The iron holder holds the iron by the iron's base and can be adjusted to accommodate different sizes of irons. The frame is also made of heat-resistant, coated, welded wire that allows for the manufacture of a light, cost-effective device. The device is also equipped with large hooks to hold most types of ironing boards and arms designed to hold extra products used during ironing.

12 Claims, 6 Drawing Sheets

WIRE RACK FOR MOUNTING AN IRON ON A WALL

FIELD OF THE DISCLOSURE

The present disclosure relates to a wire rack for mounting an iron on a wall and method of use thereof, and more specifically, to a wire rack for mounting an iron on a wall, the wire rack having a retractable rail for adjusting to different sizes of irons to be mounted on a wall and equipped with an ironing board holder and a product holder.

BACKGROUND

Articles of clothing, upholstery, and other fabrics used in households are typically made of fibers that wrinkle during washing, pressing, and handling. Clothing can also wrinkle when worn or manipulated. Shirts are tucked into pants and worn in contact with the skin, and seat covers of a couch are constantly compressed in a certain direction. Winter clothing is also sometimes stored in boxes or depressurized bags that create unwanted wrinkles. Wrinkle-free clothing and fabrics are generally preferred for aesthetical reasons.

Metal pans filled with charcoal were used in the first century BCE in China to flatten fabrics. In the early 20th century, iron boxes filled with coal were sold in the United States, but this technology was never widely accepted. In the 17th century, delta-shaped tools of cast iron began to be used. These tools had a front nose and a back heel and were placed on a fire with a removable wooden handle. While irons have slowly become almost exclusively stainless steel models, the name "iron" survived changes in materials technology. Ironing boards used in conjunction with irons were also developed during the 20th century. U.S. Pat. No. 19,390 to Vandenburg et al. teaches a primitive version of an ironing board for shirts. The most successful and widely used iron design today is the electric iron, which is heated by a resistive heating element and was invented in 1882 by Henry W. Seeley.

Wrinkle-free surfaces are desirable for a variety of functional reasons, such as enabling the pearling of water over surfaces; for aesthetical reasons, such as providing the illusion that a piece of clothing is new; and for comfort reasons, as in the case with freshly ironed bed sheets or table linens. Wrinkles are removed by ironing or smoothing a tissue or clothing. Fabrics are heated or pressurized during the ironing process to straighten fibers using the weight of the iron and the additional pressure of the arm of a user. Pressure, heat, and humidity are used jointly to smooth clothing and other fabrics. Some fabrics, such as silk, are heat sensitive and can be damaged if ironed improperly. Light wool also requires extra care, since the fibers are delicately interwoven and weak. Some fabrics, such as cotton, require the addition of water to loosen intermolecular bonds and facilitate ironing.

Most households place so much importance on ironing that it has become a routine step in the weekly laundry cycle. Ironing can be time consuming and requires equipment such as an iron, an ironing board, and surface treatment products. This troublesome task, much like folding clothes, has remained virtually unchanged over the past decades, and for this reason, improvements hold great commercial value.

Lighter irons are easier to handle but require more hand pressure to operate. Light irons are also quicker to heat but do not have lengthy internal thermal inertia that allows the surface temperature to remain unchanged when placed over a humid article of clothing. Heavier irons are often difficult to manipulate and must be stored in locations away from where they might potentially cause harm. Virtually all types of iron must be stored between uses, since households rarely have dedicated floor space or laundry rooms dedicated to ironing and handling clothing. U.S. Pat. No. 4,909,158 to Sorensen and Chinese Patent No. 1,202,339 teach the use of a combined wall cabinet equipped with a retractable ironing board fixed within the cabinet and folded up for storage. These devices do not permit users to purchase readily available ironing boards. Further, these devices are bulky and require affixing a heavy cabinet to a wall at a dedicated location. Users of these devices are also limited in their range of operation of the ironing boards. For instance, an operator is unable to access the back of the board. These devices also force users to remain in a stationary location. Other devices described in International Patent Application PCT/NL01/00129 to Okkerse and U.K. Patent Application GB 2,411,906 describe iron holders placed horizontally or attached to the ironing board to allow a hot iron to be held safely between uses or while the fabric is being repositioned. Neither of these devices is directed to short- or long-term storage of ironing boards and irons. U.S. Pat. No. 7,004,433 to Clausen et al. teaches the installation on a wall of two different superimposed components: a board holder and a iron holder. A board holder is attached to the wall in a first step and a iron holder made of one single large tab is then locked into place over the board holder. By holding the iron by the handle at a single point, irons may be damaged by their own weight and the iron may wobble in place since it is not fixed to the holder. Clausen et al. teaches a device unable to hold or adapt to different types of irons. The device as shown is bulky, heavy, and expensive to produce. The device is also incapable of holding extra ironing products or an ironing board constructed without a T-shaped foot.

What is needed is a light, adjustable device able to hold different types and geometries of irons without causing damage to the iron and able to be installed on a wall in a single operation. What is also needed is a device able to hold extra ironing products and equipped to hold ironing boards of different geometries in a limited space. What is also needed is a cost-effective, heat-resistant device able to provide the above-mentioned improvements.

SUMMARY

The present disclosure relates to a wire rack for mounting an iron on a wall and method of use thereof, and more specifically, to a wire rack for mounting an iron on a wall, the wire rack having a retractable rail for adjusting to different sizes of irons and equipped with an ironing board holder and a product holder. The iron holder holds the iron by the iron's base and can be adjusted to accommodate different sizes of irons. The frame is also made of heat-resistant, coated, welded wire that allows for the manufacture of a light, cost-effective device. The device is also equipped with large hooks to hold most types of ironing boards and arms designed to hold extra products used during ironing.

DETAILED DESCRIPTION

Figure 1:
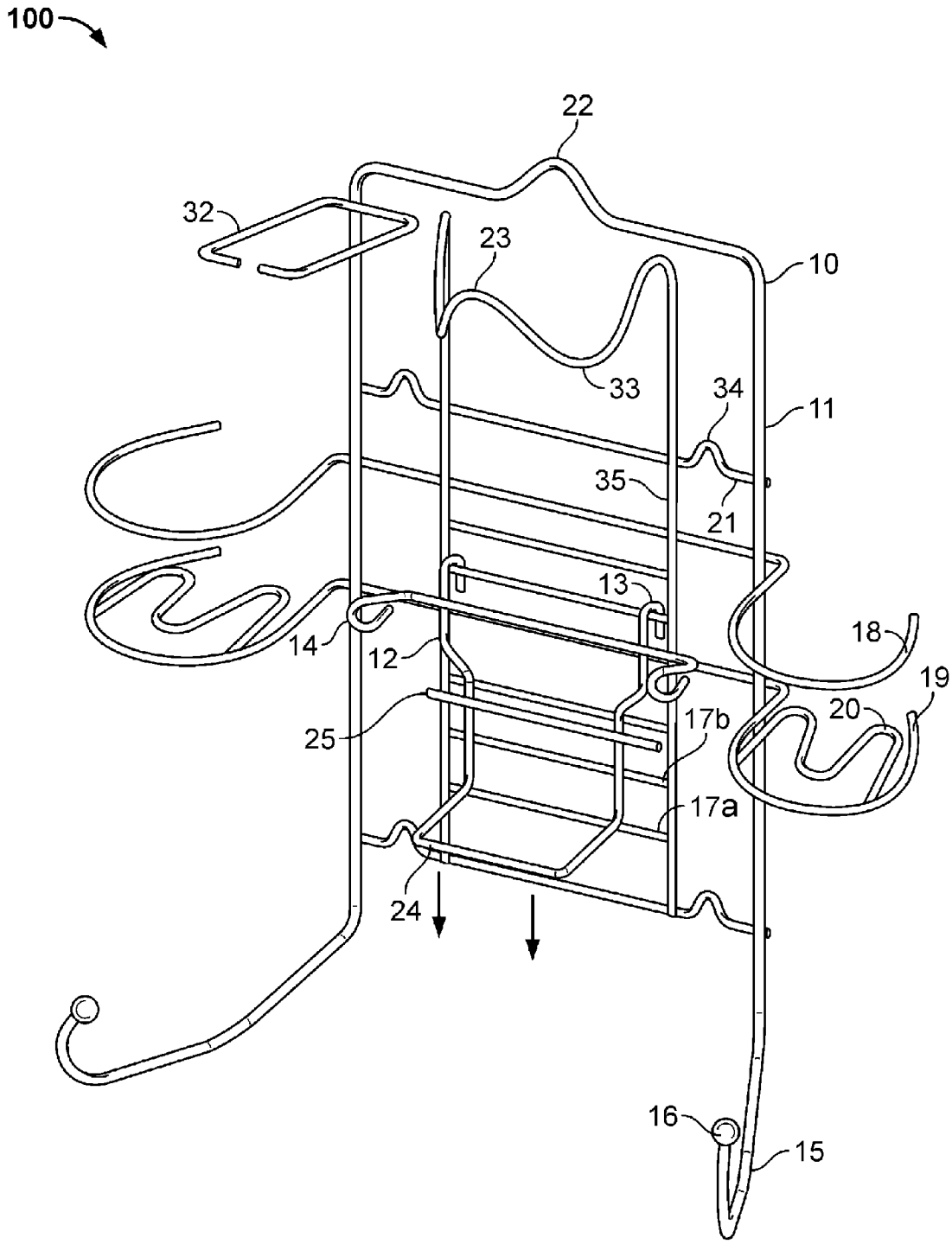
FIG. 1 is a perspective view of a wire rack for mounting an iron on a wall according to a first embodiment of the disclosure and equipped with a movable heel segment according to a possible embodiment.
Figure 2:
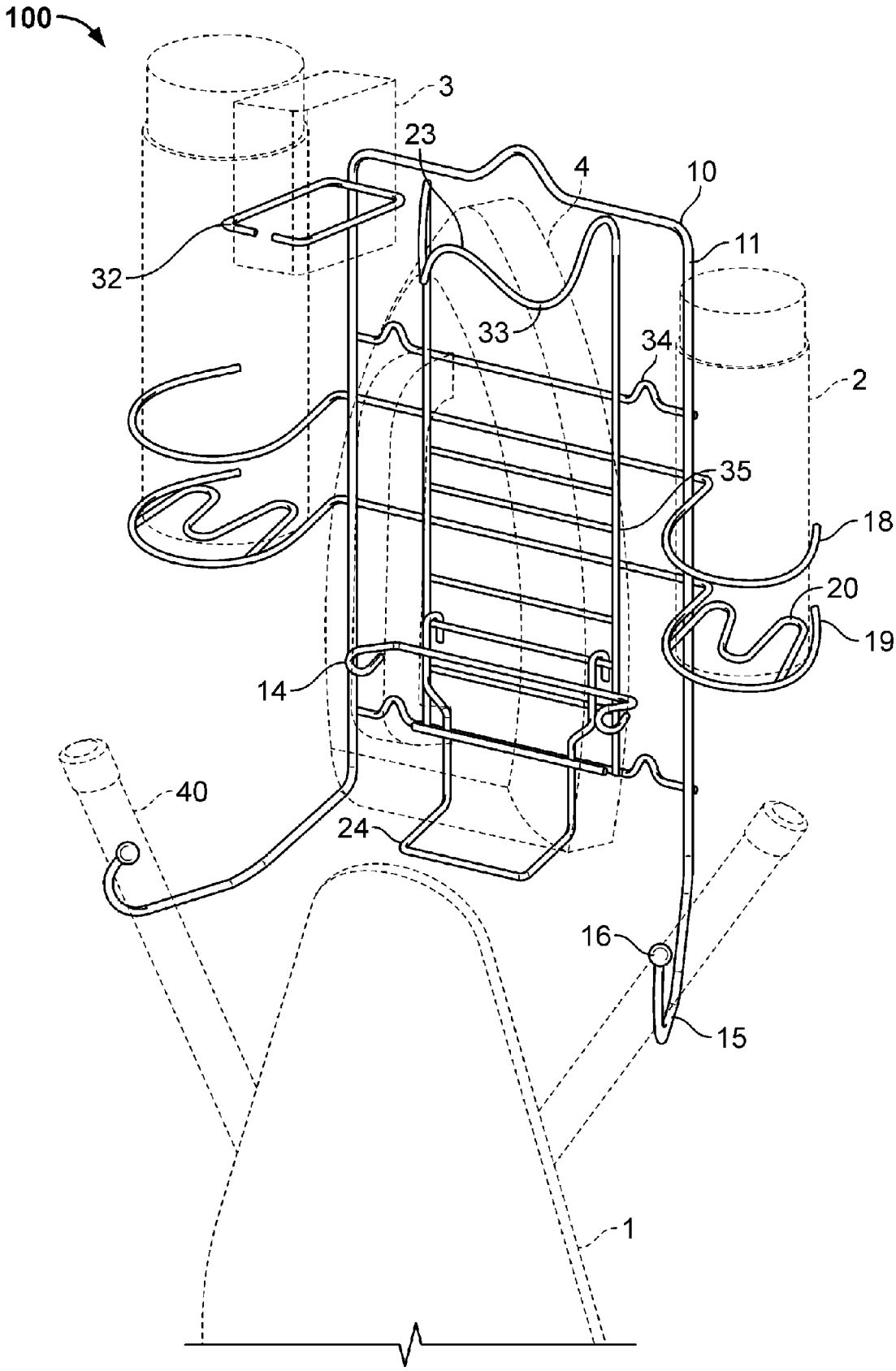
FIG. 2 is a perspective view of the wire rack of FIG. 1 showing in phantom lines the iron, ironing board, and extra products to be held by the wire rack according to a possible embodiment.

FIG. 1 shows a perspective view of the wire rack 100 according to a first embodiment of the disclosure equipped with a movable heel segment 12 according to a possible embodiment. FIG. 2 shows the wire rack 100 for mounting an iron 4 with phantom lines showing possible extra products, water storage, containers, and ironing boards placed upon the wire rack 100. The body 10 comprises a wall mount 22 as shown in FIG. 1 adapted to secure the wire rack to a wall (not shown). The wire rack 100 has a movable torso 11 adapted to secure the iron 4 to the wire rack 100 with a retractable rail 35 having an upper holder 23 adapted for engaging a nose portion of the iron 4 (shown as the pointed end), and a lower holder 24 adapted for engaging the heel portion of the iron (shown as the flat end). The wire rack also includes an arm 19 disposed on the body 10 adapted to hold extra equipment 2 and a leg 15 disposed on the body 10 adapted to hold an ironing board 1. The retractable rail 35 comprises intermediate positions located on horizontal segments 17*a*, 17*b*, etc. for moving the upper holder 23 and the lower holder 24 in relation to each other.

What is shown in FIG. 1 is a wire rack 100 with an essentially rectangular body 10 with different vertical and horizontal elements attached thereto. For example, a horizontal support brace 18 serves together with the arms 19 to hold extra equipment 2 and is fixed across the body 10 to increase the rigidity of the body 10. In one preferred embodiment, a wall mount 22 is located on the top center portion of the wire rack 100. Other wall mounts 34 are also shown and may be used if more support is needed. What is contemplated is the use of a wire rack of any type of geometry capable of giving the wire rack 100 sufficient rigidity to maintain its functions of holding an iron 4, an ironing board 1, and extra equipment 2. What is also contemplated is the use of any type of wall mount 22 or 34 located at any position on the body 10 to affix the wire rack 100 to a vertical surface. What is also contemplated is the use of any type of mounting technology, such as but not limited to bolts, nails, screws, legs, magnets, tabs, and the like. In the disclosed embodiment and as shown in FIG. 2, two legs 15 hold a board 1 using the legs tubes 40 of the ironing board 1. It is understood that ironing boards 1 can have legs of different geometries based on consumer preferences and market production. What is contemplated in one disclosed embodiment is the use of legs 15 with a protector 16 curved upward to hold the leg tubes 40 of the ironing board 1. It is understood by one of ordinary skill in the art that the size and orientation of the legs 15 may be modified to hold other types of ironing boards 1. What is also contemplated is the use of a single leg 15 or a plurality of legs 15 to achieve the same result. While the legs 15 are shown attached to the lower outside corners of the body 10, what is contemplated is the placement of legs 15 at any reasonable location to hold an ironing board 1 located below the wire rack 100.

FIG. 1 also discloses the use of two arms 19 located on each side of the wire rack 100 and attached to vertical wires. While one possible embodiment is shown, what is contemplated is the use of arms 19 located at any reasonable orientation on the wire rack 100 to hold extra equipment 2. FIG. 2 shows a configuration where two circular arms 19 hold spray cans 2 and a top arm 32 holds a small box 3. The arm 19 is shown with a bottom wire 20 serving to hold vertically the spray can while the top arm 32 is shown without a bottom wire. What is contemplated is the use of wire technology or other flat surface technology to produce and place on the body 10 any reasonable amounts and types of holders designed to hold the different extra equipment 2, 3 used during ironing. In the preferred embodiment, the wire rack 100 weighs approximately 13 oz, or less than one pound, and is about 14 inches wide by 14 inches high with a thickness of about 4 inches. The wire rack 100 in a preferred embodiment is made of formed steel wires of 1/16th inch in diameter or of other smaller diameters and is coated with a white, polymer-based thermoplastic. While one preferred embodiment is shown and disclosed in FIGS. 1-3, and a second preferred embodiment is shown and disclosed in FIGS. 4-5, what is contemplated is any type of wire rack 100 of any color, with any type of coating or even made of bare stainless steel, capable of holding the different elements disclosed within the same volume and of approximately the same weight. What is also disclosed is the use of thicker wires to form the body 10 and smaller wires to serve as the secondary features placed upon the body 10 in order to reduce the overall weight and manufacturing cost of the wire rack 100.

Figure 3:
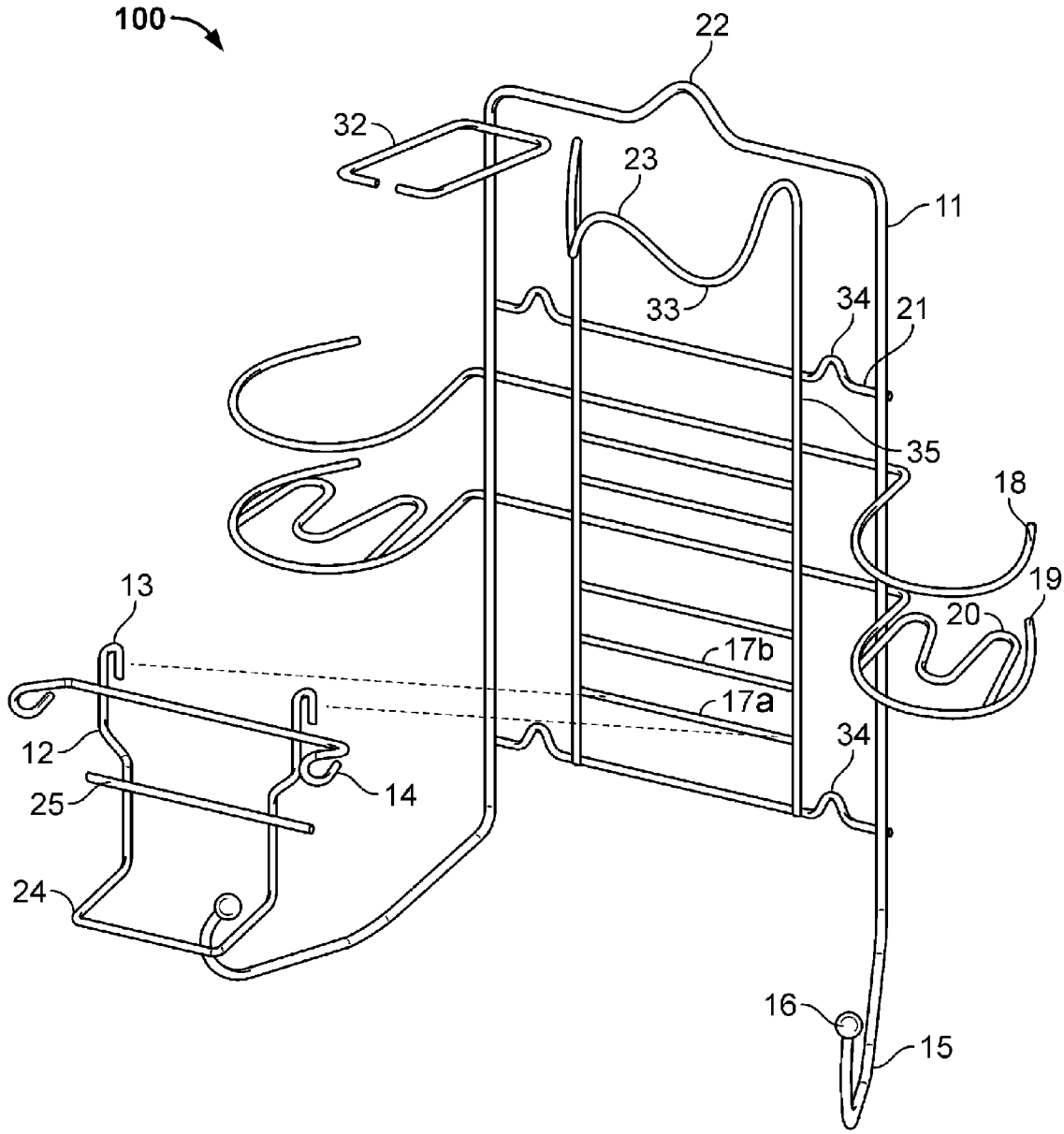
FIG. 3 is an exploded view of the wire rack of FIG. 1 according to a possible embodiment.

The wire rack 100 has a movable torso 11 adapted to secure the iron 4 to the wire rack 100 with a retractable rail 35 having an upper holder 23 adapted for engaging a nose portion of the iron 4 (shown as the pointed end) and a lower holder 24 adapted for engaging the heel portion of the iron (shown as the flat end). FIG. 3 shows an exploded view of one possible embodiment of the lower holder 24 located on a movable segment 12 of the torso 11 adapted to attach to a horizontal spacing bar 17*a*, 17*b* on a fixed segment of the torso. The movable segment 12 has a fixation device 13, shown in FIG. 3 as two hooks, capable of interlocking with one of the horizontal spacing bars 17*a*, 17*b*, etc. In the preferred embodiment as shown in FIG. 3, a handful of horizontal spacing bars 17*a*, 17*b* allow the lower holder 24 to be placed at different distances from the upper holder 23 based on the spacing of the horizontal spacing bars 17*a*, 17*b*. The movable segment 12 also has lateral tabs 14 used to hold the iron 4 in place laterally as shown in FIG. 2. The movable segment 12 includes a structural member 25 to increase the overall strength and rigidity of the movable segment 12 and acts as part of the structure placed between the bottom of the iron 4 and the wall (not shown). The lateral legs 14 as shown in FIGS. 1-3 may also be placed on the body 10 as shown in another embodiment in FIGS. 4-5.

In the embodiments shown in FIGS. 1-5, the lower holder 24 is made of a flat wire of rectangular shape and the upper holder 23 is made of a curved 33 wire adapted to receive a pointed nose section of an iron 4. In these embodiments, a user inserts the nose portion of the iron 4 inside the upper holder 23 and locks the nose behind the curved wire 33. Once the nose is locked, the heel portion of the base is then slid into the lower holder 24 without risk of falling since the top portion of the iron 4 is already locked in place. While one possible configuration of the upper holder 23 and the lower holder 24 is shown, what is contemplated is any type of upper holder 23 and lower holder 24 based on the existing and preferred geometries of commercial irons in the marketplace. For example, if an iron with two noses is commercialized, the upper holder 23 would be made of two different curves 33. What is also contemplated is the use of any other fixation device to hold the iron 4 in place on the body 10, including but not limited to magnets, rotating tabs, clipped on parts, sliding parts, and the use of external fixation means.

Figure 4:
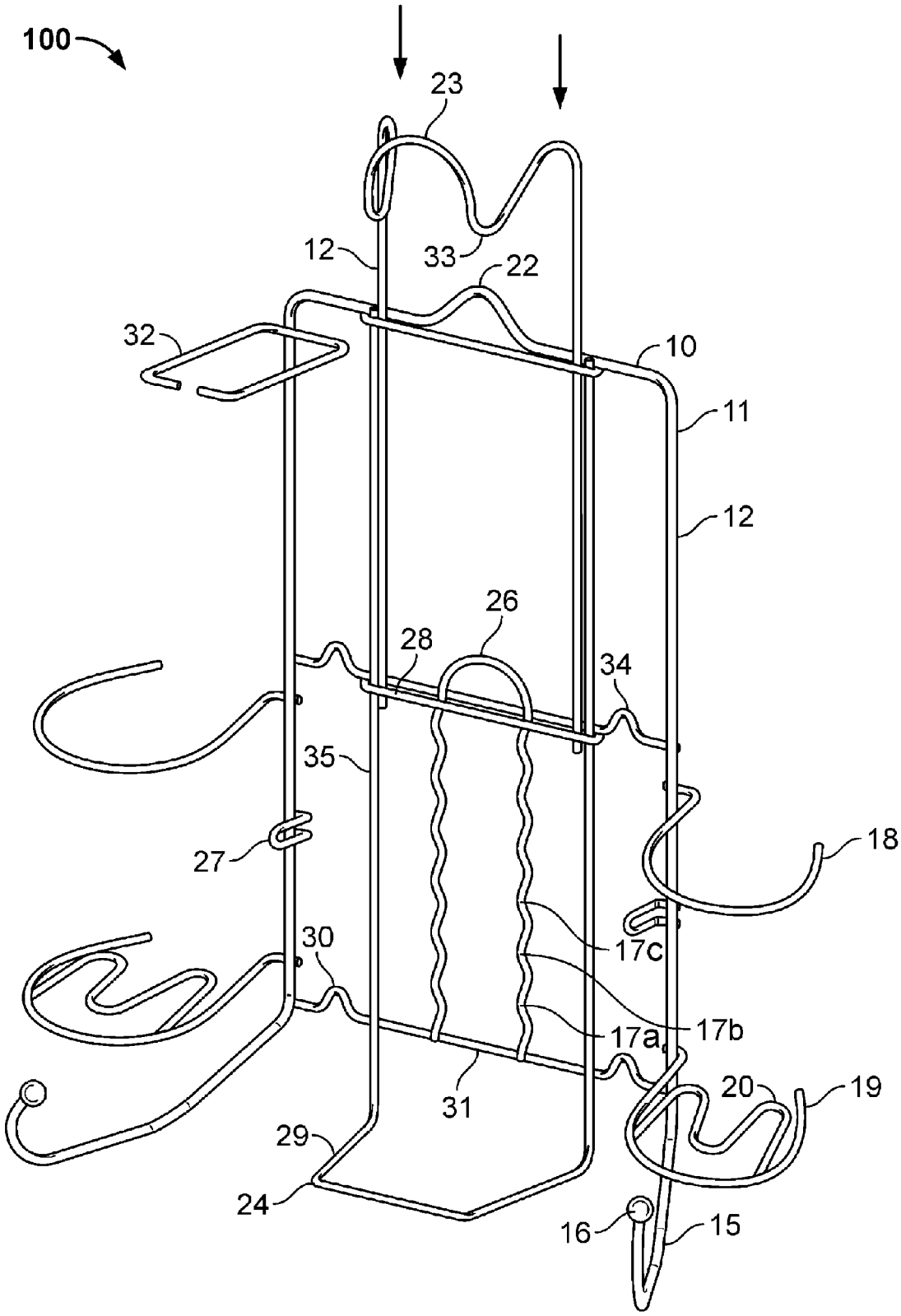
FIG. 4 is a perspective view of the wire rack equipped with a movable nose segment according to a second possible embodiment.
Figure 5:
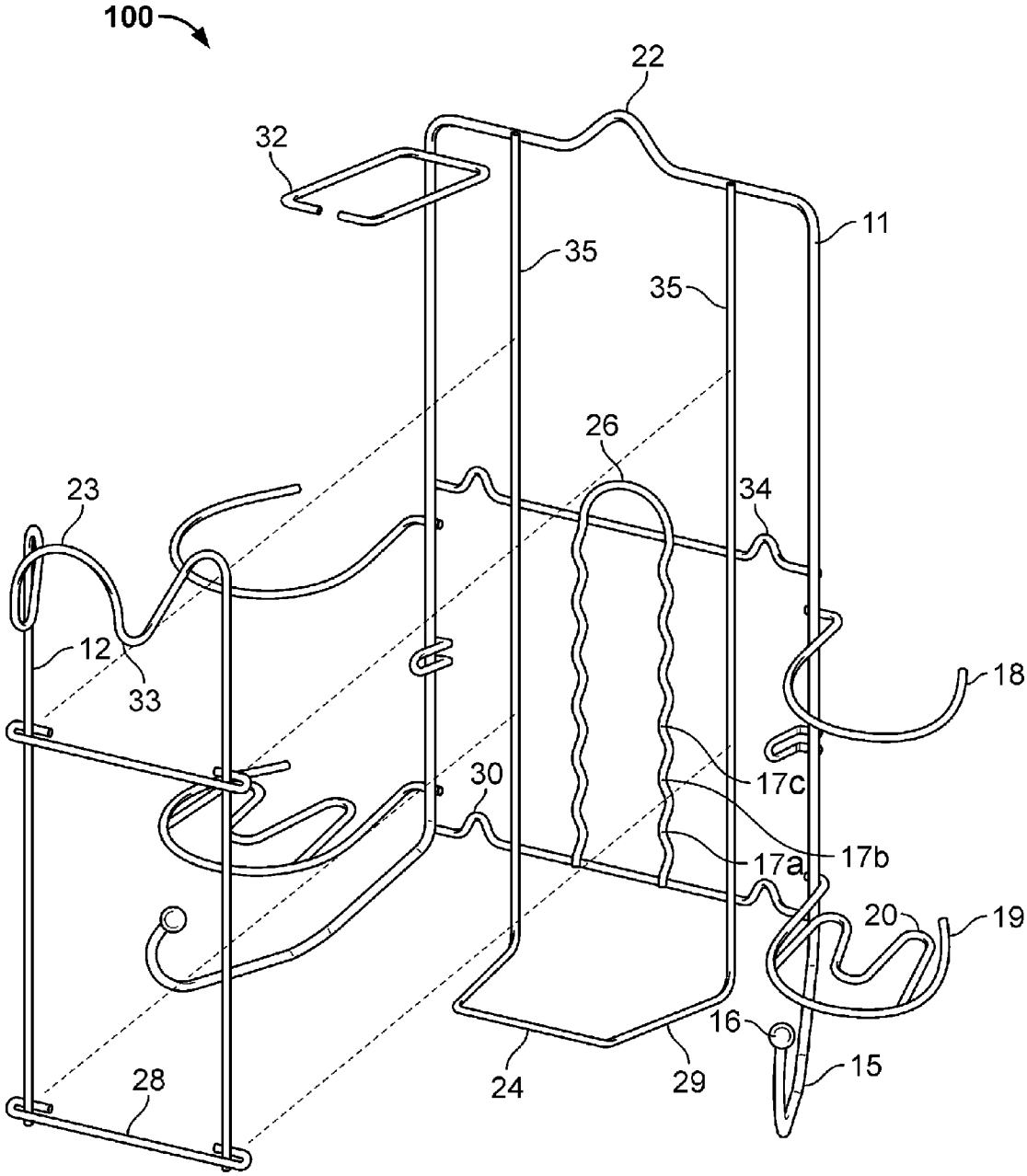
FIG. 5 is an exploded view of the wire rack of FIG. 4 according to a possible embodiment.

In another embodiment shown in FIGS. 4-5, the wire rack 100 includes an upper holder 23 located on a movable segment 12 of the torso 11 adapted to repose on a segment of a vertical spacing bar 26 on a fixed segment of the torso 11. FIGS. 4-5 show a series of fixed steps 17*a*, 17*b*, 17*c*, corresponding to the horizontal spacing bars 17*a*, 17*b*, 17*c* in FIGS. 1-3, which serve the same function of allowing the movable segment 12 to be placed at regular intervals along the torso 11 on the rail 35. In the embodiment shown in FIGS. 4-5, the movable segment 12 is not hooked in place but bent into place into the sliding position shown in FIG. 5. The upper holder 23 is then pushed down as shown by the arrows in FIG. 5 to secure the iron in place. The use of a bent segment with spaced steps 17*a*, 17*b*, 17*c* instead of the horizontal spacing bars is one of many possible embodiments associated with spacing adjustable structures associated with wire frame technology. It is understood that the following disclosure contemplates any possible adjustable technology.

Figure 6:
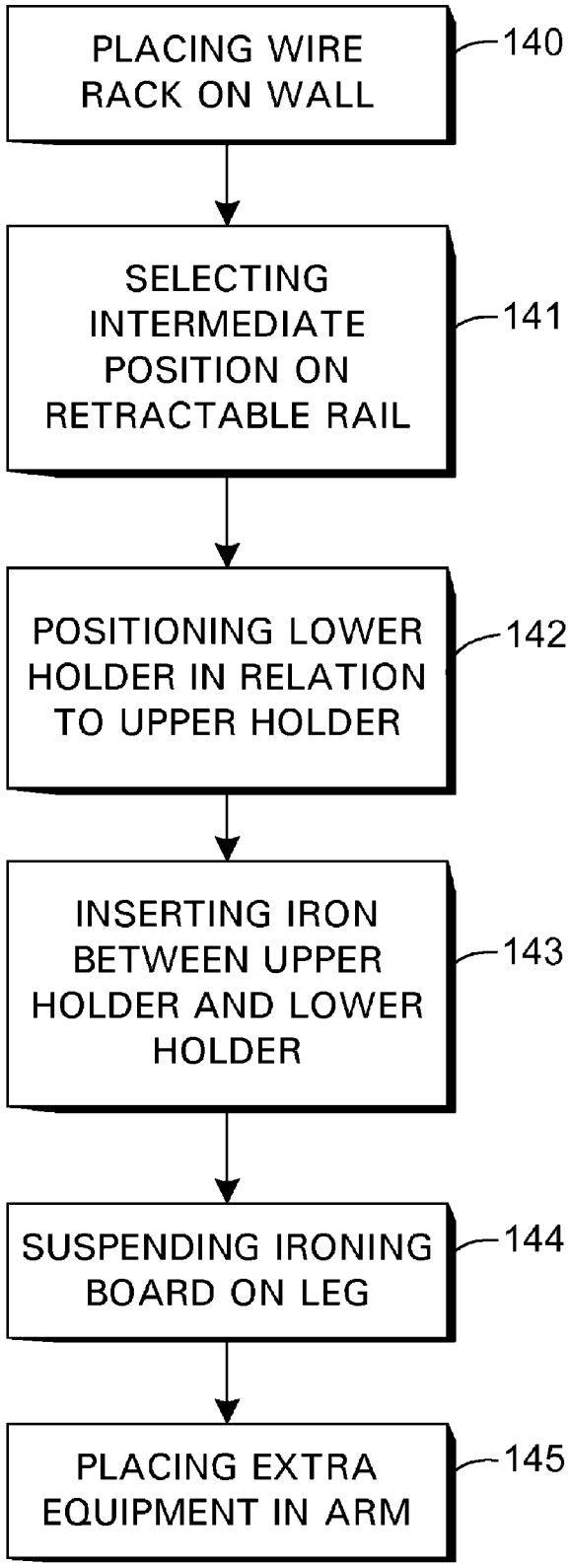
FIG. 6 is a block diagram of a method for storing ironing equipment according to a possible embodiment.

Finally, FIG. 6 teaches a method for storing ironing equipment, the method comprising the steps of placing a wire rack on a wall 140, selecting an intermediate position on the retractable rail at a distance sufficient to hold the iron between the upper and lower holders 141, positioning the lower holder in relation to the upper holder at a distance sufficient to hold the iron 142, inserting the iron between the upper and lower holders 143, suspending an ironing board on the legs 144, and finally, placing extra equipment in the arms 145.

It is understood by one of ordinary skill in the art that these steps correspond to the general steps to be taken to practice this method of this disclosure. Other auxiliary steps may be taken to store ironing equipment, but they do not affect the validity and completeness of the disclosure of this general method. Persons of ordinary skill in the art appreciate that although the teachings of the disclosure have been illustrated in connection with certain embodiments and methods, there is no intent to limit the invention to such embodiments and method. On the contrary, the intention of this application is to cover all modifications and embodiments falling fairly within the scope of the teachings of the disclosure.

What is claimed is:

1. A wire rack for mounting an iron on a wall, comprising:

a body comprising a wall mount adapted to secure the wire rack to the wall, and a movable torso adapted to secure the iron to the wire rack with a retractable rail slidably on the body in a vertical position having an upper holder made of a curved wire adapted for engaging a pointed nose portion of the iron, and a lower holder adapted for engaging the heel portion of the iron;

an arm disposed on the body adapted to hold an article of extra equipment; and a leg disposed on the body adapted to hold an ironing board, wherein the retractable rail comprises intermediate positions for moving the upper holder and the lower holder in relation to each other.

2. The wire rack for mounting an iron on a wall of claim 1, further comprising two legs disposed on the body and adapted to hold the ironing board.

3. The wire rack for mounting an iron on a wall of claim 1, further comprising two arms disposed on the body adapted to hold two different articles of extra equipment.

4. The wire rack for mounting an iron on a wall of claim 1, wherein the body is made of bent welded wires.

5. The wire rack for mounting an iron on a wall of claim 4, wherein the bent welded wires are coated with temperature-resistant plastic.

6. The wire rack for mounting an iron on a wall of claim 4, wherein the wires are made of stainless steel.

7. The wire rack for mounting an iron on a wall of claim 1, wherein the body further comprises lateral iron holders.

8. The wire rack for mounting an iron on a wall of claim 1, wherein the lower holder is located on a movable segment of the torso adapted to attach to a horizontal spacing bar on a fixed segment of the torso.

9. The wire rack for mounting an iron on a wall of claim 1, wherein the upper holder is located on a movable segment of the torso adapted to repose on a segment of a vertical spacing bar on a fixed segment of the torso.

10. The wire rack for mounting an iron on a wall of claim 9, wherein the lower holder includes a vertical support and the upper holder includes a locking support.

11. The wire rack for mounting an iron on a wall of claim 8, wherein the lower holder includes a vertical support and the upper holder includes a locking support.

12. A method for storing ironing equipment, the method comprising the steps of:

placing on a wall a wire rack with a body having a wall mount adapted to secure the wire rack to the wall, and a movable torso adapted to secure an iron to the wire a retractable rail slidably on the body in a vertical position having an upper holder made of a curved wire adapted for engaging a nose portion of the iron, and a lower holder adapted for engaging the heel portion of the iron, an arm disposed on the body adapted to hold an equipment, and a leg disposed on the body adapted to hold an ironing board, wherein the retractable rail comprises intermediate positions for moving the upper holder and the lower holder in relation to each other;

selecting an intermediate position on the retractable rail at a distance sufficient to hold the iron between the upper holder and the lower holder;

positioning the lower holder in relation to the upper holder to the distance sufficient to hold the iron;

inserting the iron between the upper holder and the lower holder;

suspending an ironing board on the leg; and placing an article of extra equipment in the arm.

* * * * *